United States Patent [19]

Itoh

[11] 4,138,017

[45] Feb. 6, 1979

[54] DEVICE FOR SELECTING AND REMOVING UNSATISFACTORY CAPSULES BEFORE FILLING SATISFACTORY CAPSULES WITH CHEMICALS

[75] Inventor: Toshiharu Itoh, Osaka, Japan

[73] Assignee: Kabushiki Kaisha Osaka Jidoki Seisakusho, Sakai, Japan

[21] Appl. No.: 789,276

[22] Filed: Apr. 20, 1977

[30] Foreign Application Priority Data

Oct. 8, 1976 [JP] Japan ..... 51/121417

[51] Int. Cl.[2] ..... B07C 1/10

[52] U.S. Cl. ..... 209/680

[58] Field of Search ..... 209/82, 85, 87

[56] References Cited

U.S. PATENT DOCUMENTS 3,997,058 12/1976 Greer ..... 209/87

*Primary Examiner*—Allen N. Knowles

[57] ABSTRACT

A machine for filling capsules with chemicals and for capping such capsules is very complicated and should be very efficient. In order to reduce the burden on such a machine and to simplify its structure, this invention provides a separate device positioned ahead of such a machine for selecting and removing from the capsules being supplied to such a machine such unsatisfactory capsules as capsules deformed into an oval form and the like. In addition, this device prevents the occurance of conditions causing the machine to be stopped because of the accumulation of capsules in the passages therethrough and thereby allows the machine to run smoothly and effectively.

6 Claims, 3 Drawing Figures

DEVICE FOR SELECTING AND REMOVING UNSATISFACTORY CAPSULES BEFORE FILLING SATISFACTORY CAPSULES WITH CHEMICALS

This invention relates to a device for selecting and removing unsatisfactory capsules prior to filling capsules with chemicals.

In the conventional mechanical filling of capsules, such operations as adjusting the orientation of the capsules in order to orient them in the same direction, removing caps temporarily to open the bodies of the capsules, filling the capsules with chemicals, and capping the capsules, have all been performed automatically and mechanically. Thus, the capsule filling machine is very complicated, and when unsatisfactory capsules such as deformed ones are mixed with satisfactory capsules during the above operations, a passage-way for the capsules moving through the machine can be tied up because of only one unsatisfactory capsule. Thus, the efficiency of the machine is reduced. It is very difficult to remove such unsatisfactory capsules in order to allow the machine to operate satisfactorily, because they are in the highest part of the machine. Thus, such operation tends to be neglected. This causes a decrease in the efficiency of the machine, which is a great defect in the conventional machine which should have a good efficiency.

It has been proposed to remedy this defect by providing a machine with a built-in device for selection and removing unsatisfactory deformed capsules. However, such a machine is very complicated and causes many troubles and so it is not suitable.

An important object of this invention is to provide a separate device for selecting and removing unsatisfactory capsules before they can be fed to a capsule filling machine.

A second object is to provide a device which will prevent feeding of any unsatisfactory capsule to the capsule filling machine so as to prevent the machine from being stopped.

A third object is to simplify the capsule filling machine by providing separately therefrom a device for selecting unsatisfactory capsules.

A fourth object is to improve the efficiency of the capsule filling machine.

A fifth object is to enable the capsule filling machine to run smoothly.

In accordance with the invention, a preparatory device is separately provided to select and remove unsatisfactory deformed capsules before they go to a filling machine. Because the preparatory device is not provided on the filling machine, any unsatisfactory capsule will have no effect on the filling machine. Thus the filling operation can be continued without difficulty.

DETAILED DESCRIPTION OF THE INVENTION

Figure 1:
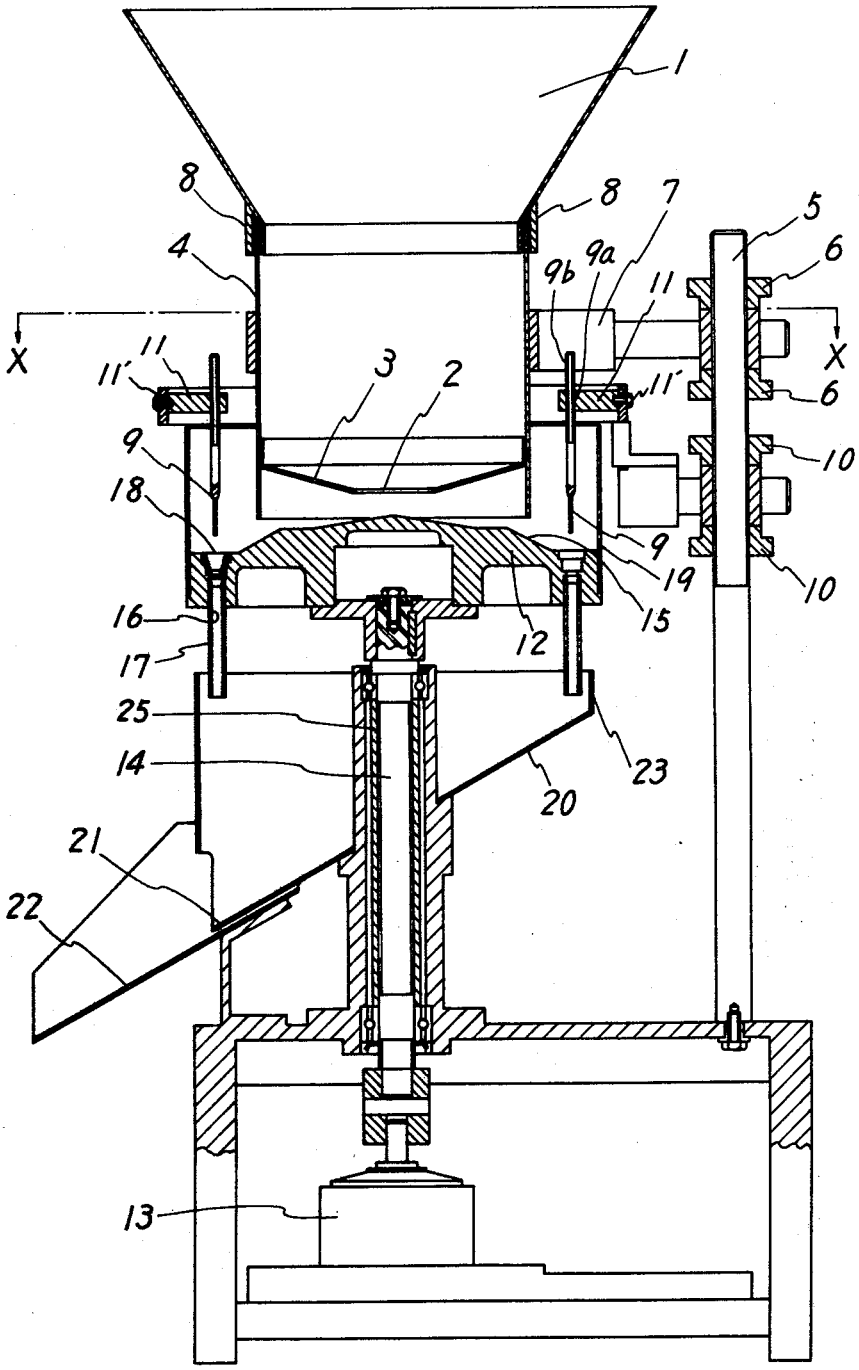
FIG. 1 is a vertical sectional view of the structure of the device of the present invention.
Figure 2:
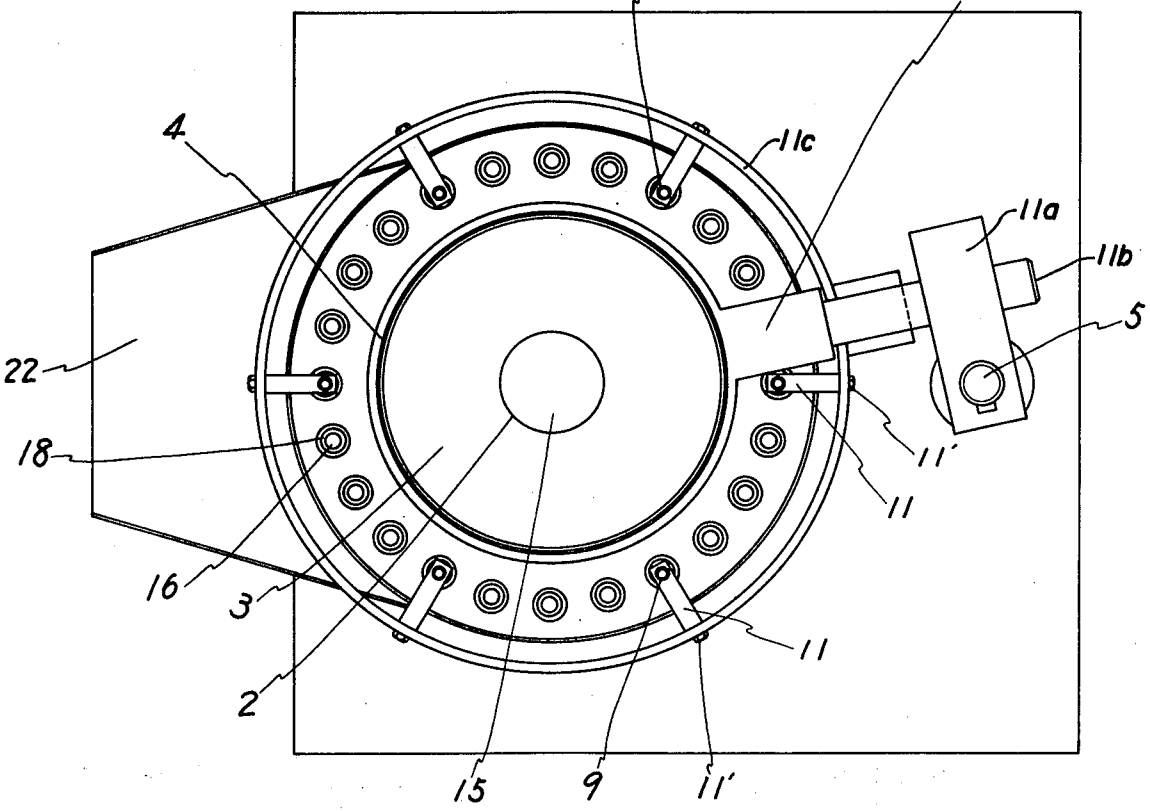
FIG. 2 is a cross sectional view taken along line x—x in FIG. 1.

As seen in the figures, a stationary hopper 1 provided at a high place on the device contains empty capped capsules in random positions. An exit opening 2 is situated in the lower central portion of the hopper 1. A surrounding member 3 is positioned around opening 2 and is included downwardly towards the center thereof. An outer wall 4 surrounds the exit 2 of the hopper 1, and has a cylindrical shape, and is supported by a supporting arm 7. The other end of the arm 7 is mounted on a bolt 5 and held by nuts 6 to allow the position of the supporting arm 7 to be adjusted up and down freely. A fixed stand 8 supports the hopper 1. The bolt 5 is stationary supported on a machine stand. Further nuts 10 are threaded onto the bolt 5 and on end of an arm **11*a* which is movable up and down bolt 5 is held between the nuts 10. An arm 11*b* has one end mounted in arm 11*a* and has the other end attached to a ring 11*c* around the outer wall 4. Arms 11 are connected to ring 11*c* by pins 11' and project inwardly of ring 11*c* and are rotatable on the pins 11'. A stagnation adjusting member 9 is mounted on the inner end of each arm 11 and has male threads 9*b* engaged with female threads 9*a* in the arm 11 so as to support the stagnation adjusting member 9**. When each stagnation adjusting member is rotated, it can be adjusted up and down.

A rotating plate 12 is positioned beneath member 3 and receives capsules thereon as it rotates.

The rotating plate 12 is rotated by a rotating shaft 14 coupled with a variable speed motor 13. The central portion of a receiving surface 15 on the plate 12 is raised. The receiving surface 15 is so positioned that the highest point on the surface thereof is below the exit opening 2 of the hopper 1. In the outer circumference of the receiving surface 15 there are a plurality of openings 18 for longitudinal pipes 17, each of which has an internal cross-section 16 a little larger than the diameter of the cap of a capsule. An outer cylindrical wall 19 surrounds the outer circumference of the plate 12. An inclined guide 20 is positioned below the longitudinal pipe 17 and is inclined downwardly and laterally. The lower edge 21 is connected to a guide 22 for conducting capsules to a capsule filling device. A protecting wall 23 surrounds the outer circumference of the inclining guide 20 and keeps the capsules coming down pipes 17 from escaping from the machine. A spacer 25 passes through a central portion of the inclined guide 20 between the bearings for shaft 14. The capsules travel with the plate and engage the stagnation adjusting members 9 the lower ends of which are in the way of the moving capsules. This causes the members 9 to swing as the arm 11 rotates around pin 11', and the lower portion of the stagnation adjusting members 9 oscillate. This overcomes the stagnation of capsules. Thus, capsules are led smoothly into the openings 18 of longitudinal pipes 17, extending downwardly through the plate 12.

In order to overcome stagnation of the capsules, it is possible to cause the longitudinal pipes 17 to carry out an up-and-down movement. In order to achieve this motion however, the structure of the machine must be complicated and there will be many difficulties in its manufacture. In this invention, therefore, the stagnation adjusting members 9, which are simple devices capable of being oscillated as has been described above, are provided in the path of the travel of the capsules to achieve the same purpose quite easily.

Since the stagnation adjusting members 9 are mounted on the arms 11 so as to be adjustable up and down at will, they can be adjusted precisely in accordance with the size of capsules used. What is more, the arm lever 11 is associated with and supported by the nut 10 which is capable of being adjusted up and down at will. When, therefore, it is necessary to adjust several stagnation adjusting members 9 simultaneously, the up and down movement of the nut 10 makes it possible to adjust them simultaneously.

Figure 3:
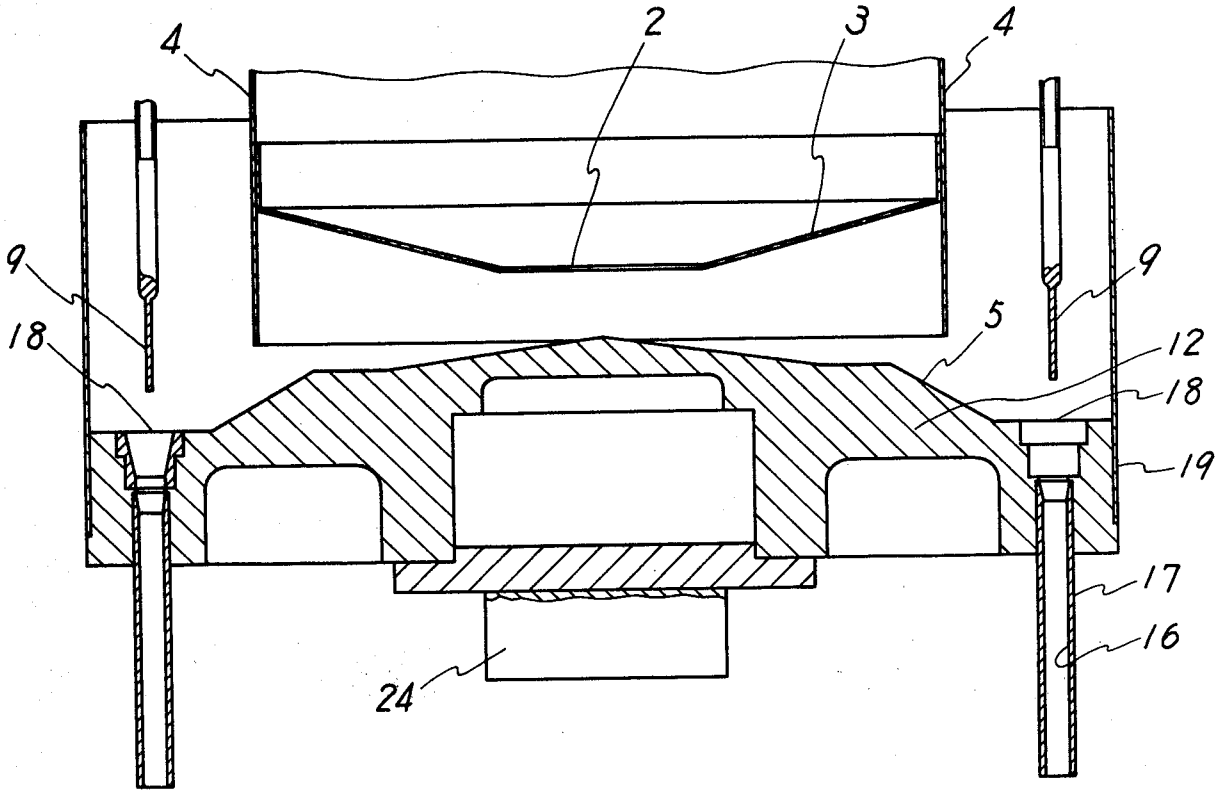
FIG. 3 is a vertical sectional view, on an enlarged scale of the vibration means of the device of FIG. 1.

Instead of a rotary plate 12, it is possible to cause capsules to move smoothly by vibrating the plate by means of a vibrator 24, as shown in FIG. 3.

In the apparatus as has been described above, empty capped capsules positioned at random in the hopper 1 flow from the exit 2 by gravity into the upper surface 15 of the rotary plate 12. Then they move toward the outer circumference of the plate 12. They will move more smoothly if they are rotated or vibrated. The capsules move along the inclined part of surface 15 in a line in perfect order, and they tend to move smoothly without being stagnated. Thus, any size capsules can be caused to move smoothly in perfect order by making the space between the bottom of the outer wall 4 and the upper surface 15 of the plate 12 proper for the size of the capsules by raising or lowering the outer wall 4 in accordance with the size of the capsules.

The capsules moved in such a way as described above tend, however, to be stagnated in the area between the openings 18 and the outer wall 19. In order to overcome this condition, this invention provides the stagnation adjusting members 9 positioned vertically in the path of travel of the capsules so that the capsules move smoothly without any stagnation at all. Thus normal empty capped capsules which come to the openings 18 will pass through then one by one, and flow down the longitudinal pipe 17; and down the inclined guide 20 and into the guide groove 22, so that they are fed to a capsule filling machine. When unsatisfactory capsules, such as either a capsule body or a cap or both which is deformed or flat, come to the inner cross-section 16 of the pipes 17, the width thereof is greater than the diameter of the cross-section 16 due to the deformation. Therefore, such unsatisfactory capsules cannot pass through the longitudinal pipes 17 and are stopped at the openings 18. In such a case, such unsatisfactory capsules are removed from plate 12 by hand from time to time to return the operation to normal. An undeformed capsule body without a cap and an undeformed cap without a capsule body are also unsatisfactory, but they do not cause stagnation. Such unsatisfactory items are not removed by the present device, but are removed in the filling machine proper.

As has been described above, the apparatus of this invention makes it possible to send only satisfactory capsules to a capsule filling machine. Thus, this invention makes it possible to simplify the construction of a capsule filling machine. While the maximum filling capacity of conventional large-sized filling machine is 2,300 capsules per minute, that of a smaller-sized filling machine fed with capsules from an apparatus of this invention is 2,500 to 3,000 capsules per minute. This is the great advantage of this invention.

What is claimed is:

1. An apparatus for removing deformed capsules from a plurality of capsules to be fed to a capsule filling machine, said apparatus comprising a stationary hopper at the top of the apparatus and having an opening in the bottom thereof, a capsule receiving plate positioned immediately below the bottom opening of said hopper and having the upper surface inclined from the center of the plate toward the periphery thereof, means connected to said plate for moving said plate while it remains in position below said hopper for facilitating the movement of capsules from the hopper toward the periphery of the plate, said plate having a plurality of holes around the peripheral portion of the upper surface thereof and pipes extending through said plate from said holes with the internal diameter of the pipes being only slightly larger than the diameter of the cap of an acceptable capsule, and inclined guide below said plate for guiding capsules which pass through said pipes to a capsule filling machine, a wall around the periphery of said plate extending above the upper surface of the plate for preventing capsules from falling off the upper surface of the plate, and stagnation adjusting members positioned above the outer peripheral portion of the upper surface of said plate and depending toward the upper surface of the plate with the lower ends spaced from the upper surface of the plate a distance less than the size of the capsules, said stagnation adjusting members being supported from said machine for lateral oscillation above said plate for preventing stagnation of capsules on the outer peripheral portion of the upper surface of said plate.

2. An apparatus as claimed in claim 1 in which said plate is rotatable in a horizontal plane and said means comprises means for rotating said plate.

3. An apparatus as claimed in claim 1 in which said means comprises means for vibrating said plate.

4. An apparatus as claimed in claim 1 in which said hopper is adjustably mounted on said apparatus for vertical movement relative to said plate.

5. An apparatus as claimed in claim 1 in which said stagnation adjusting members are mounted on said apparatus for vertical movement relative to said plate.

6. An apparatus as claimed in claim 1 in which said stagnation adjusting members are each individually vertically adjustably mounted on said apparatus.

* * * * *